United States Patent [19]

Jones et al.

[11] 4,213,714

[45] Jul. 22, 1980

[54] PRINTER HAVING VARIABLE CHARACTER DENSITY

[75] Inventors: Clifford M. Jones; William A. Surber, both of Waynesboro, Va.

[73] Assignee: General Electric Company, Waynesboro, Va.

[21] Appl. No.: 847,585

[22] Filed: Nov. 1, 1977

[51] Int. Cl.[2] ..... B41J 3/12; B41J 19/32

[52] U.S. Cl. ..... 400/124; 400/306; 400/322

[58] Field of Search ..... 364/900 MS File; 400/120, 121, 124, 303–306, 320, 320.1, 322, 328

[56] References Cited

U.S. PATENT DOCUMENTS

| | | | |
|---|---|---|---|
| 3,858,703 | 1/1975 | Duley | 400/124 |
| 3,905,463 | 9/1975 | Boyce et al. | 400/124 |
| 3,950,685 | 4/1976 | Kramer | 400/328 X |
| 3,970,183 | 7/1976 | Robinson et al. | 400/124 |
| 4,034,842 | 7/1977 | Giacone | 400/322 X |
| 4,050,563 | 9/1977 | Menhennett | 400/124 |

FOREIGN PATENT DOCUMENTS

| | | | |
|---|---|---|---|
| 1205744 | 11/1965 | Fed. Rep. of Germany | 400/124 |
| 2533312 | 2/1976 | Fed. Rep. of Germany | 400/320.1 |
| 2515557 | 10/1976 | Fed. Rep. of Germany | 400/124 |
| 2306835 | 11/1976 | France | 400/124 |

*Primary Examiner*—Paul T. Sewell
*Attorney, Agent, or Firm*—Michael Masnik

[57] ABSTRACT

An improved matrix printer is described employing a high order, single track incremental position encoder to provide a plurality of electrical reference signals representative of predetermined print positions along a platen and for locating matrix columns at the predetermined print positions. An electronic circuit is provided for varying the predetermined print positions at which the matrix columns can be located.

12 Claims, 7 Drawing Figures

10
12
14
16
18
19
20
21
22
23
24
25
26
28
30
32
34
44
45

PRINTER HAVING VARIABLE CHARACTER DENSITY

BACKGROUND OF THE INVENTION

This invention relates to improved matrix printers. The invention relates more particularly to a printer which is adapted to print at variable character widths.

In one form of relatively high speed printing device, a character printing head is transported parallel to a stationary platen and is repeatedly accelerated in a transverse direction toward the platen. The printing head forms characters on the medium during the transport.

One form of relatively high speed printer comprises a dot matrix printer. In dot matrix printing, a character is formed by a plurality of printed dots which are selected from a rectangular array or matrix of dot locations arranged in columns and rows. The printing head in one form of dot matrix impact printer includes a plurality of individually selectable print wires which are aligned to form one or more of the dots of a matrix column. These print wires are accelerated toward the platen by associated solenoids at a matrix column location to cause printing on a record medium through an inked ribbon. Scanning of the head along the platen results in the successive columnar printing of additional dots necessary to form the characters at successive matrix locations.

The printing of a plurality of characters along a line requires that the position of the head be monitored and controlled. In dot matrix printing for example, the position of the array of print wires with respect to a dot matrix column should be established. To this end, head position encoders have been utilized which establish the desired positions along the platen of the dot matrix columns. This has been accomplished in one arrangement by utilizing an optical sensing system for measuring relative movement between the printhead and the stationary platen. In a particular optical sensing system, a circular disc having a plurality of incremental reference indicia, for example, lines or slits, formed thereon is mechanically coupled to a printhead drive motor. A stationary optical sensor is positioned adjacent the disc and radiant energy, which is projected from a source through incremental reference slits of the disc, causes the sensor to generate electrical signals representative of the position or printing positions and thus of the dot matrix columns to be printed. An alternative optical sensing arrangement utilizes a linear encoder instead of a rotating disc, linear fixed reference marks and an optical sensor which is mechanically coupled to and transported with the moving printhead. In either case, incremental reference signals are generated which are utilized for locating dot matrix columns of a dot matrix character.

The reference or position incremental signal has been utilized in several ways for locating the dot matrix column. In one arrangement, a reference incremental signal is generated which corresponds to each dot matrix column to be formed so that the signal itself is representative of the location of the dot matrix column. In another arrangement, a reference incremental signal is sensed at the location of an initial dot matrix column of a character. The printhead advances at a relatively constant printhead velocity and successive dot matrix column locations within the character are determined by timing the movement of the printhead with respect to the initial column. In still another arrangement, multiple encoder tracks are employed for separately sensing the initial and terminal locations of matrix columns of a dot matrix character.

The above-described matrix column location sensing arrangements provide for sensing the locations at a particular character density. For example, a presently utilized examplary character density is ten characters per inch. At times, it is desirable to increase the character density to relatively larger densities on a page. Character density can greatly be changed by varying the width of a character. Character width variation requires that spacing between adjacent dot matrix columns of a character be relatively changed. The reference incremental signals described hereinbefore are unsuitable to accommodate alternative printing at different character widths. In prior arrangements, the drive system was physically modified in order to provide for different character widths. For example, a drive wheel or gear was substituted in order to change the matrix column spacing for a character of different character width. Alternatively, an encoder disc was provided which included a plurality of reference tracks having reference lines and wherein each of the tracks was related to a particular character width.

The prior art arrangements for determining matrix column locations for different character widths exhibit several disadvantages. With gear or wheel changing, the operation of the printer is dedicated to a single character width. Relatively complex and costly circuit arrangements are required in the case of the encoder discs having multiple tracks.

Accordingly, it is an object of this invention to provide an improved matrix printer which is adapted to print at different character densities.

Another object of the invention is to provide an improved matrix printer having relatively non-complex and economical means for printing at a plurality of different character widths.

Another object of the invention is to provide an improved impact printer adapted to mix characters of different character widths.

A further object of the invention is to provide an improved means, including an encoder disc, for printing characters at different character widths.

SUMMARY OF THE INVENTION

In accordance with the general features of the present invention, a matrix printer is provided having means for generating a plurality of electrical incremental position signals representative of predetermined possible print positions along a platen and for locating matrix columns at the possible predetermined print positions. Means are provided for varying the predetermined print positions at which matrix columns are located. Means are also provided for causing the print positions to be predetermined integral multiples of desired character widths.

In accordance with other features of the invention, the incremental position signals provide plurality of print positions between adjacent matrix columns. A first plurality of print positions occur between adjacent matrix columns at a first character width, and, a second differing plurality of print positions occur between adjacent matrix columns at a second differing character width. The plurality of print positions occurring between adjacent matrix columns is greater in number for relatively smaller character print width and is less for a relatively greater character width.

In accordance with more particular features of the invention, a dot matrix, impact printer for reproducing characters of selectively differing character widths and wherein the character width of a character being formed is determined by spacing between adjacent matrix columns in a character matrix, includes an elongated platen and a printhead means which is adapted to print a matrix column of component character marks. Transport means advance the printer head means in a lateral direction, parallel to the platen. Means, including a body having a plurality of reference marks formed thereon, is provided for generating a plurality of electrical incremental position signals which are representative of print positions along the platen. A circuit means provides a character width signal which is representative of the character width of a character being printed. A circuit means which is responsive to the reference signals and to the character width signals selects print positions at which matrix columns are located for different character widths and provides electrical, matrix column signals timed in accordance with selected print positions. A circuit means is also provided which is responsive to the electrical matrix column signals and to a character signal for causing the printhead means to form a matrix column of component character marks at a matrix column location.

BRIEF DESCRIPTION OF THE DRAWINGS

These and other objects and features of the invention will become apparent with reference to the following specification and to the drawings wherein.

DETAILED DESCRIPTION

Figures 1, 2:
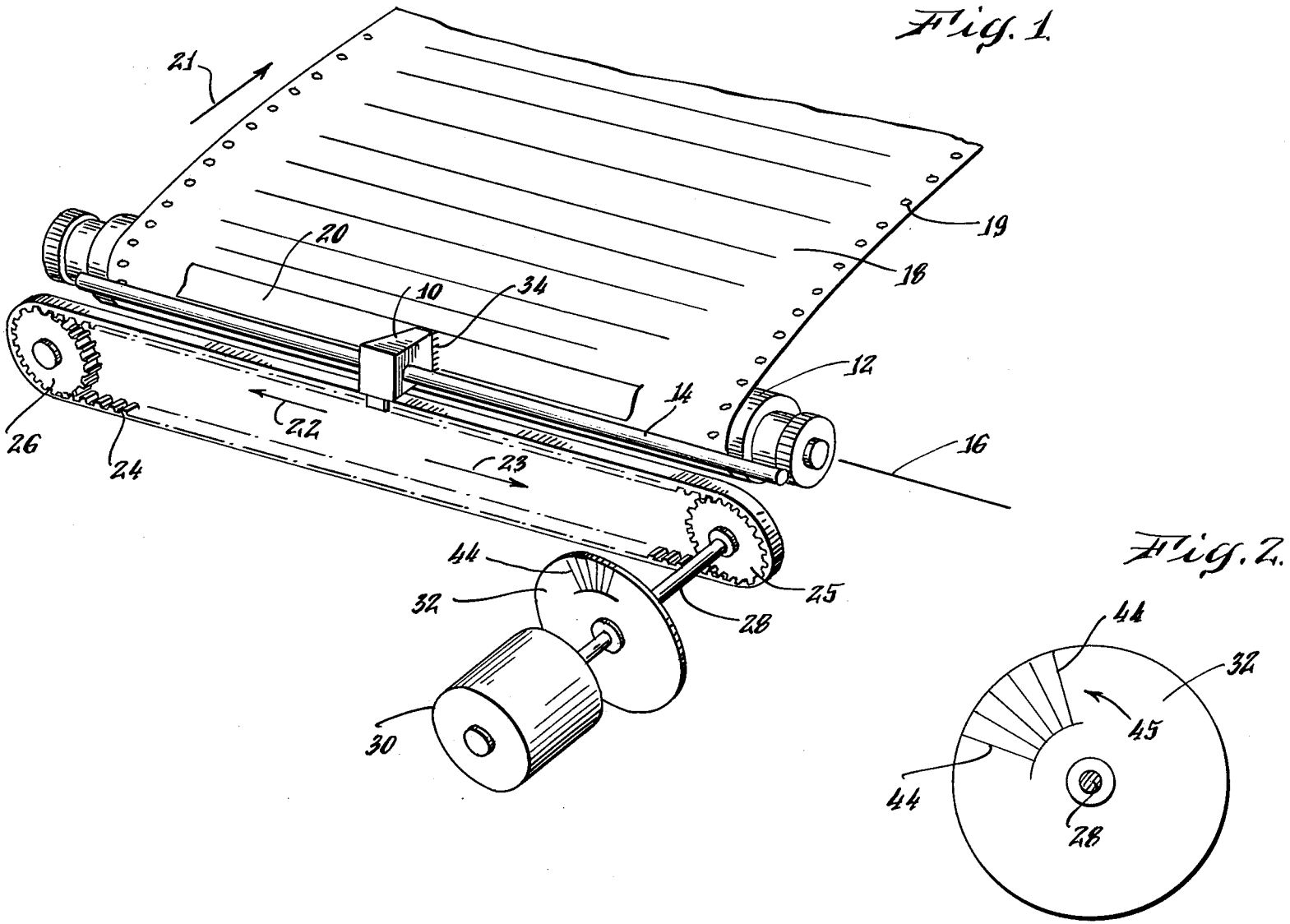
FIG. 1 is a fragmentary, perspective view of a matrix impact printer with which the present invention is utilized.
FIG. 2 is a diagram illustrating an encoder disc used with the printer of FIG. 1.

Referring now to FIG. 1, an impact printer of the dot matrix type is shown to comprise a printhead means comprising a printhead 10 which is supported for transport adjacent a platen 12 on a track comprising a machined rod 14. The rod 14 is spaced in a transverse direction from the platen and extends in a general direction parallel to a longitudinal axis 16 of the platen. Positioned between the head 10 and the platen 12 are a record medium comprising an edge perforated, elongated, sheet 18 and an inked print ribbon 20. Conventional cog wheels, not shown, engage edge perforations 19 and provide for stepped advancement of the sheet 18 in the direction of the arrow 21. The printhead 10 is alternatively transported laterally along the track 14 in directions represented by arrows 22 and 23, parallel to the platen 12. It is advanced by a gear belt 24. The gear belt 24 is coupled to the head 10 and extends about a drive capstan 25 and an idler pulley 26. Rotating motion is imparted to the capstan 25 by a drive shaft 28 of a servo motor 30. An encoder disc 32, described more fully hereinafter, is mounted on the drive shaft 28 for rotation therewith. As the gear belt 24, which is mechanically coupled to the printhead and to the capstan 25 is rotated, the head 10 will be advanced along the rod 14 alternatively in directions indicated by the arrow 22 and 23, depending upon the direction of rotation of drive shaft 28. Advancement is continuous or alternatively is stepped. The head 10 will be actuated in a direction transverse to the platen axis 16 as it is being advanced in the direction of the arrow 23. This transverse actuation causes printing of component, character dots. Similarly, the head 10 will also be transversely actuated when it is advanced in the direction of the arrow 22 so that printing occurs when the head is transported in either direction.

The printhead 10 includes a vertically aligned array of print wires which is referred-to generally in FIG. 1 by the reference numeral 34. Each of the print wires of the array is selectively, electromagnetically energized by an associated solenoid winding, not illustrated. A print wire advances in a transverse direction with respect to the axis 16 of the platen and a leading segment of the print wire impacts the ribbon 20, the sheet 18 and the platen 12. Impact causes printing of an inked area corresponding to a face of the forward wire segment. One or more of the print wires are selectively energized to print character dots of a single matrix column. As the head is advanced laterally, the array of print wires are selectively energized to form one or more dots at successively located matrix column locations, thereby forming a dot matrix character.

Figure 3:
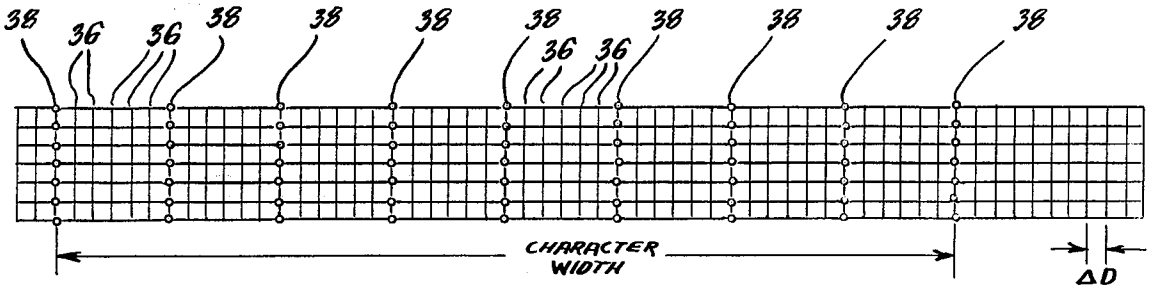
FIG. 3 is a diagram illustrating a rectangular, dot matrix array for characters of a first character printing density.
Figure 4:
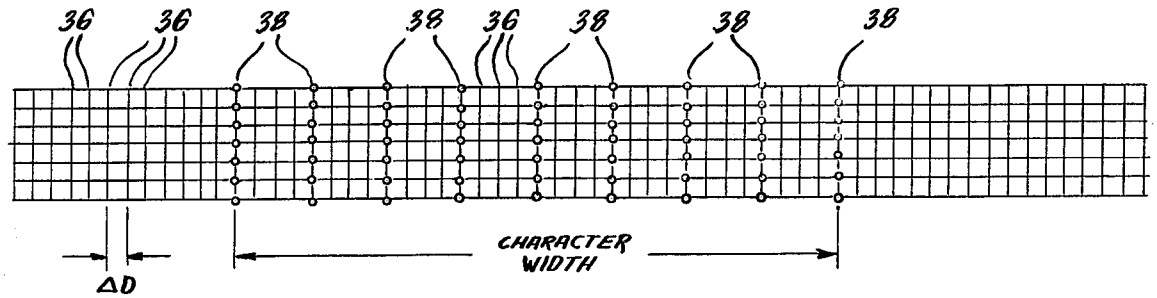
FIG. 4 is a diagram illustrating a rectangular, dot matrix array for characters of a second character printing density.

Variable character width can best be appreciated by reference to FIGS. 3 and 4. These figures illustrate an area which is scanned by the head 10 during its lateral movement along the platen. Reference numeral 36 indicates a plurality of print positions and reference numeral 38 indicates matrix column locations. The reference numeral 38 indicates 9 matrix column locations in FIGS. 3 and 4. The area encompassed within the 9 matrix locations represents the width of the character matrix. It is apparent from these figures that character matrix is substantially wider in FIG. 3 than it is in FIG. 4 and that a same character printed in the matrix of FIG. 3 and of FIG. 4 will be substantially wider in FIG. 3 than in FIG. 4. The character formed in the matrix of FIG. 4 will provide greater character density since more of these relatively narrow characters can be fitted into a length of printing medium than can the character with the wider matrix of FIG. 3.

This compressability is accomplished in accordance with a feature of the invention by the generation of a plurality of incremental position signals which are representative of the predetermined possible print positions 36 along the platen. It is seen that the possible print positions 36 in FIGS. 3 and 4 are spaced the same distance apart and that the matrix column locations 38 of FIGS. 3 and 4 each located at one of the print positions. The character width is a predetermined integral multiple of the distance between adjacent print positions. For example, the character widths of FIGS. 3 and 4 are 48 and 32 print positions, respectively. The width may be larger, as indicated hereinafter, to provide for intercharacter spacing. The distance D is, accordingly, a submultiple of the character width. The provision of a plurality of incremental position signals corresponding to print positions along the platen enables repositioning of the matrix column locations at different print positions in order to compress or to expand the character size and therefore to reduce or increase the character density. Thus, in FIG. 3, the matrix columns are spaced by an equal multiple of print positions and a matrix column is located at every sixth print position. Similarly, in FIG. 4, the matrix columns are located at every fourth print position. Alternately, the matrix columns of a character are spaced by different numbers of print positions as for example, to enhance the appearance of the character. The incremental position signals provide for a first plurality of possible print positions intermediate adjacent matrix columns at a first character width and a second differing plurality of possible print positions intermediate adjacent matrix columns at a second differing character width. With reference to FIG. 3, five print positions occur between adjacent matrix columns for a character at a first character width. In FIG. 4, a second differing plurality of print positions occurs between the adjacent matrix columns. This second plurality comprises three print positions. Thus, by providing a plurality of electrical incremental position signals which are representative of relatively small, predetermined possible print positions along the platen, and by providing means for varying the print position at which a matrix column is located, variable width characters can be printed.

Figure 5:
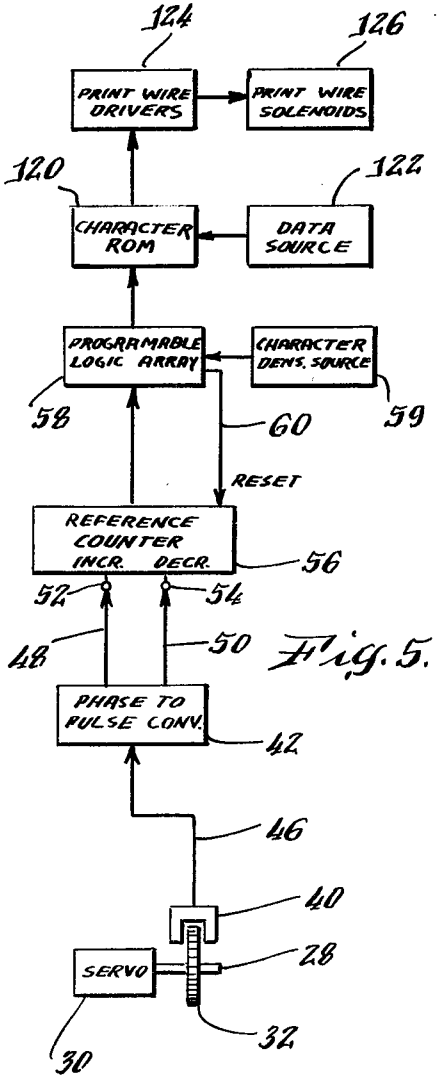
FIG. 5 is a block diagram of an impact printer constructed in accordance with features of this invention.

Referring now to the FIGS. 2 and 5, a means for generating the plurality of incremental reference signals which are representative of predetermined possible print positions along the platen includes a body comprising the disc 32, having a plurality of indicia 44 formed thereon, means comprising a head position transducer 40 for detecting passage of the indicia to provide incremental position signals, and phase to pulse converter circuit means 42 for providing incremental position signal outputs which are indicative of the rate and the direction of rotation of the disc 32. The indicia 44 of disc 32 comprise radially extending slits 44 which are arrayed in a single, circular track 45 about the disc. The head transducer 40 which is conventional and not shown in detail includes a source of radiant energy and is positioned for projecting radiant energy toward the slits of the rotating disc. The head transducer 40 also includes first and second photo detector means for sensing projected radiant energy and for generating first and second output signals. The photo detectors are spaced apart in a circumferential direction by an integral number of slits 44 plus ¼ slit so that the detector signals are quadrature related and are utilized for indicating both rotation and the direction of rotation of the disc 32. These signals are applied over a line 46 to the phase to pulse conversion circuit means 42. The output of this converter, on line 48, comprises a first reference signal representative of rotation of the disc in a first direction and alternatively, on a second line 50, a reference signal representative of the rotation of the disc in a second oppostie direction.

The reference indicia 44 are formed to a relatively high resolution on the disc 32. Each slit then transmits radiant energy which is detected and generates a reference signal pulse which is representative of predetermined possible print positions along the platen. The relatively high resolution of the slits results in closely spaced print positions on the platen. In one example which is not deemed limiting in any respect, one inch of linear travel of the head 10 results in the generation of 660 print position signals. At a character density of 10 characters per inch, there are 66 reference signals and 66 corresponding possible print positions at which the nine matrix columns can be located.

The pulses from the head position transducer are applied to incrementing and decrementing terminals 52 and 54, respectively of a bi-directional, binary, reference counter 56. The output of the binary counter 56 is applied to, and is decoded by, a programmable logic array 58, described hereinafter. A second binary input to the programmable logic array 58 is provided from a character density signal source 59. A reset output is derived from the programmable logic array 58 on line 60 and is applied to the counter 56 for resetting the counter. Counter 56 will be automatically reset when the counter attains a count equal to a predetermined modulus for a character density of characters being printed. Character modulus represents the predetermined number of possible print positions assigned for printing the matrix columns of a character matrix for a selected character width. For example, a character density of 10 characters per inch will have a character modulus of 66. A character density of 15 characters will, for example, have a character modulus of 44. In the example given hereinbefore, 66 incremental position signals are generated for each character matrix for a character density of ten character per inch. The programmable logic array generates a reset pulse when the reference counter attains the count of 66. Similarly, lesser counts representing a smaller modulus for a character matrix at greater character densities will be cleared by a pulse on line 60 from the programmable logic array 58.

Figures 6, 7:
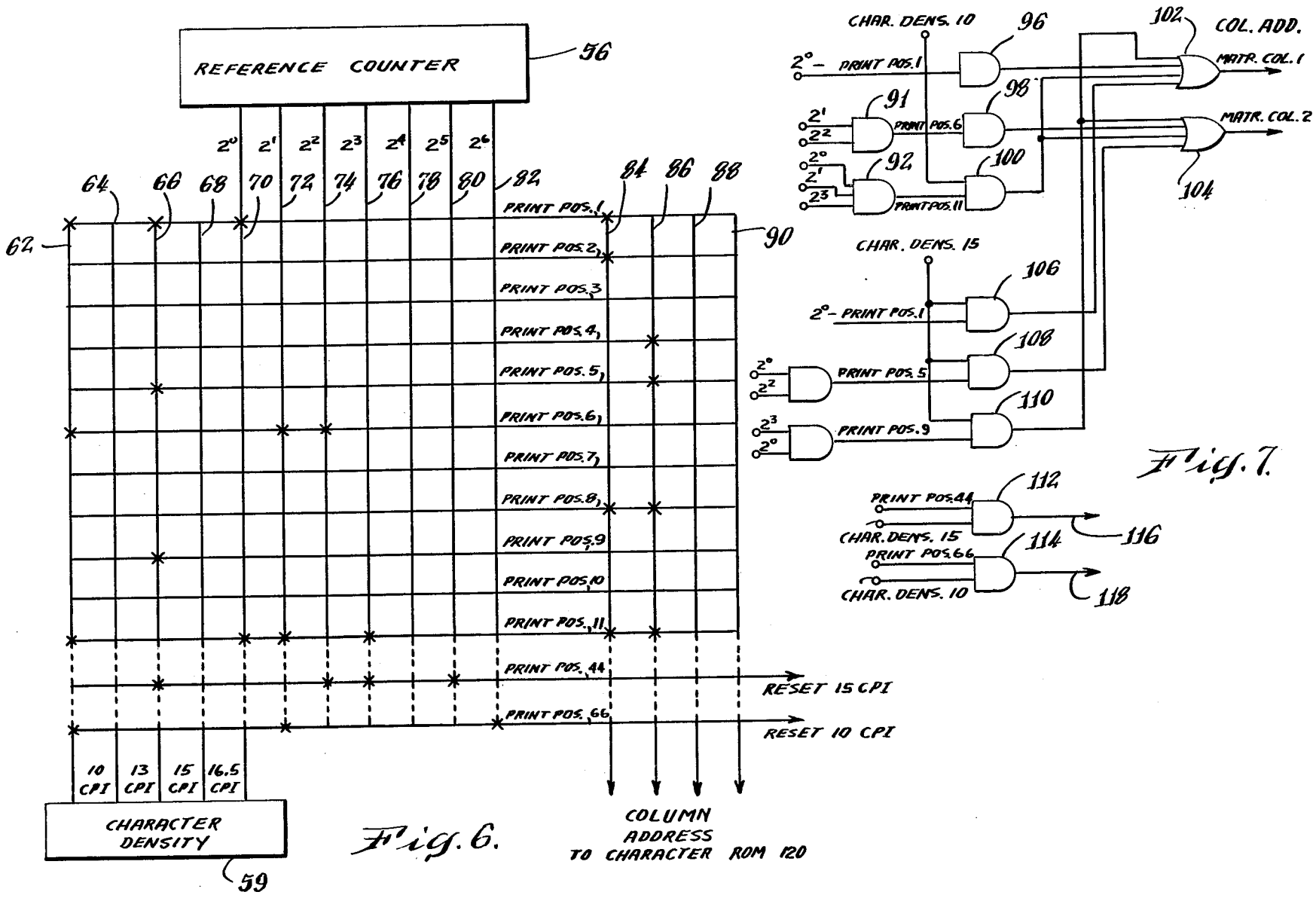
FIG. 6 is a diagram of a logic array of FIG. 5.
FIG. 7 is a partial schematic, logic diagram for the array of FIG. 6.

A diagrammatic representation of the programmable, logical array 58 is illustrated in FIG. 6. The array which comprises a logic matrix, is illustrated in more detail in FIG. 7. It includes a plurality of vertically enabled lines 62–82 representative of the character width and of the incremental position count of reference counter 56. The horizontal lines numbered 1 through 10 represent print positions 1 through 10 of a character matrix. It will be appreciated that the diagrammatic representation of FIG. 6 is for the purpose of illustrating that combinations of signal events from the reference counter and a character density signal results in particular outputs. In interpreting this representation, the x's at the junction of vertical lines 62–82 and the line print pos. 1 - print pos. 10 indicate possible print positions for the selected character density. It will be seen that at the density of 10 characters per inch of line 62, a matrix column is located at print position 1, 6 and 11. For purposes of simplifying the drawings, the entire array print pos. lines 1–66 are illustrated and those horizontal lines between print positions 10 through 44 and 44 through 66 are represented by dotted line segments. It is apparent, however, that at a character density of ten characters per inch, and with a 9 column matrix, the matrix columns, which occur at every successive five print positions, will also occur at six successive print positions of 16, 21, 26, 31, 36 and 41. Similarly, at a character density of 15 characters per inch, the matrix column will be located at print positions 1, 5, 9, etc. As indicated hereinbefore, character appearance considerations may render it desirable to vary the inter-column spacing within a character. The spacing between matrix columns within a character can be varied to predetermined amounts. However, a matrix column 38 will be located at a predetermined possible print position and inter matrix column spacing will be an integral multiple of the spacing ΔD between possible print positions. The reference counter 56 is automatically reset when the modulus for a selection character width is reached. In the case of 10 characters per inch, the modulus is selected to be 66. Since 45 space locations have been utilized in forming a dot matrix character at 10 characters per inch, the remaining space locations are utilized for intercharacter spacing. When the modulus for the selected character width is attained, a reset signal is generated on the reset line thereby resetting the reference counter for initiating the repeat of a countup of the character density modulus.

In the diagrammatic representation of FIG. 6, output column addresses for the first three matrix columns of a character matrix are represented at the intersections of the print pos. lines and those vertical lines 84–90 bearing the crosses. These four lines indicate which of the 9 matrix columns, at any one time, is selected for printing. The matrix column address will occur sequentially, depending upon the direction of head movement.

FIG. 7 is a logic diagram for implementing the arrangement of FIG. 6. The diagram of FIG. 7 illustrates logic circuit means for those functions indicated in the diagram of FIG. 6. It is understood that the diagrams of FIGS. 6 and 7 can be expanded in accordance with the schemes illustrated therein. The outputs from the position reference counter 56 are applied to AND gates 91 and 92 to indicate reference signals which are representative of print positions 5 and 10 of a character matrix. A reference counter output on line 94 is representative of print position 1. These signals are applied to AND gates 96, 98 and 100 along with the character width signal for a selected character density of 10 C.P.I. The outputs from gates 96–100 are indicative of print positions at which matrix columns are located. The outputs of these gates are applied to OR gates 102 and 104 to provide matrix column address information to a character ROM, discussed hereinafter. Similarly, AND gates 106, 108 and 110 are provided and enabled by reference counter outputs for print positions 1, 4 and 8 and by character width signal for the character density 15 C.P.I. The output of AND gates 106, 108 and 110 are signals indicative that the matrix columns are located at print positions 1, 4 and 8. These signals are applied to the gates 102 and 104 and provide matrix column address information to a character ROM. The logical array of FIG. 7 can be expanded to include the remaining matrix column locations for the character densities indicated and can be expanded to include other character densities. AND gates 112 and 114 are provided for generating reference counter reset pulses on output lines 116 and 118, respectively. These AND gates are enabled by the character density signals 19 and 10 and by the matrix modulus (print position) chosen for the particular character width. Additional reference character AND gates can be provided for other character densities chosen. The logic array of FIG. 7 can be provided by discrete circuit means or by integrated circuit means. It can also be implemented with memory devices, as for example, an ROM of American Micro Systems Inc. identified as AMI-S 8564.

The column address generated by the program logical array 58 is applied to a character ROM 120 along with an input signal from a source of character information 122. Print wires of the printhead array 34 of the printhead 10 are each individually energized by an associated solenoid to cause the printing of dots in a matrix column. The solenoids at any one matrix column location are selectively energized by information derived from the read only memory 120. One such ROM comprises AMI-S 8564 referred-to hereinbefore. The ROM 120 stores a 9 column dot format for each of the characters which can be formed by the printer. The ROM is addressed by a character code such as the standard ASCII code which is derived from the source of character information 122 comprising a communication data line or a keyboard switch for the printer. The ASCII code selects the particular character which is to be printed while the column address information from the programmable logic array 58 scans the 9 column format and indicates a particular matrix column to be printed at any one time. The output of the character ROM provides signals to print wire drivers 124 for energizing the solenoids 126 of a matrix column.

There has thus been described an improved printer having means for selectively and electrically varying the character width of characters being printed and density of characters on a line. The arrangement is advantageous in that it permits these character variations from an operator selectable keyboard source or alternatively from a communication line. Since the character variation is electrically selectable, the character width can be varied along any line being printed.

While there has thus been described a particular embodiment of the invention, it will be apparent to those skilled in the art that variations may be made thereto without departing from the spirit of the invention and the scope of the appended claims.

What is claimed is:

1. In a matrix printer for reproducing characters of selectively different character widths, said printer comprising head means which is transported in a lateral direction parallel to a platen, said head means adapted to form a matrix column of component character marks for forming a character on a record medium, a desired width of a character being determined by the spacing between adjacent matrix columns in a character matrix, the improvement comprising:

first means for generating a single set of electrical, incremental position signals representative of predetermined possible print positions which are all spaced apart an equal distance along said platen and for locating matrix columns at selected ones of said predetermined possible print positions, second means coupled to said first means for electronically changing the predetermined print positions at which matrix columns are located, and means for causing the distance between such selected adjacent print positions to always be a predetermined integral submultiple of the character width.

2. In a matrix printer for reproducing characters of selectively different character widths, said printer comprising head means which is transported in a lateral direction parallel to a platen, said head means adapted to form a matrix column of component character marks for forming a character on a record medium, a desired width of a character being determined by the spacing between adjacent matrix columns in a character matrix, the improvement comprising:

first means for generating a single set of electrical, incremental position signals representative of predetermined possible print positions which are all spaced apart an equal distance along said platen and for locating matrix columns at selected ones of said predetermined possible print positions, second means coupled to said first means for electronically changing the selected predetermined print positions at which matrix columns are located, and means for causing the distance between such selected adjacent print positions to always be a predetermined integral submultiple of the character width, said electrical signals providing for a plurality of possible print positions between adjacent matrix column locations.

3. An improved matrix printer for reproducing characters of selectively differing character widths, the character width of a character being determined by spacing between adjacent columns in a character matrix, comprising:

(a) an elongated platen having a longitudinal axis thereof;

(b) a printhead means adapted to form a matrix column of component character marks;

(c) transport means for advancing said printhead means in a lateral direction, parallel to said longitudinal axis;

(d) means for generating a plurality of electrical incremental position signals representative of equally spaced possible print positions along said platen, said electrical signals provide for a first plurality of possible print positions between adjacent matrix columns for a first character width, and a second differing plurality of possible print positions between adjacent matrix columns for a second different character width;

(e) means for providing character width signals representative of a plurality of different widths for characters to be printed;

(f) circuit means responsive to said electrical incremental position signals and to said character width signals for selecting print positions at which matrix columns are located for different character widths and for providing an electrical matrix column signal timed in accordance with such selected print positions;

(g) means providing a character signal; and, (h) circuit means responsive to said matrix column signal and character signal for causing said printhead means to print component character marks defining a character.

4. The matrix printer of claim 3 wherein said transport means includes a drive motor having a drive shaft thereof, said means for generating a plurality of electrical signals includes a body coupled to said drive shaft for movement thereof corresponding to movement of said drive shaft, said body having a plurality of reference marks formed thereon, said reference marks positioned in side by side relationship on a single track on said body and spaced apart for timing said electrical incremental position signals.

5. The printer of claim 4 wherein said body comprises a circular disc and said reference marks formed thereon comprise a plurality of radially extending indicia formed in said disc, said indicia positioned in a single circular track on said disc, means for detecting the passage of said indicia to provide detection signals, and means for generating electrical incremental position signals in response to said detection signals.

6. The printer of claim 3 including a reference counter adapted to count to predetermined different counts for different character widths.

7. The printer of claim 6 wherein said circuit means responsive to electrical incremental position and character width signals comprises a matrix logic circuit array.

8. The impact printer of claim 7 including a reference counter adapted incrementally to count within a predetermined modulus corresponding to a desired character width and wherein said matrix logic circuit array is adapted for generating a signal for resetting said counter means when said counter has counted to said predetermined modulus count.

9. The printer of claim 3 wherein said circuit means responsive to said matrix column and character signals includes electrical memory means for storing matrix patterns for a plurality of differing characters to be printed and said matrix column signals address successive matrix column patterns of a character to be printed.

10. The printer of claim 9 including printhead circuit driver means and said memory means provides output signals for enabling one or more of said output driver means.

11. Printer control apparatus adapted for operation with a printer of the serial dot matrix character printing type in which a printing head carrying selectively actuable matrix printing elements moves along the line to be printed for producing characters of selectively different widths in response to input signals representative of a plurality of different character widths for characters to be printed comprising a source of output pulses indicative of such head movement, a print control counter responsive to said output pulses for producing signals for controlling the print line locations where the actuation of printing elements is to be effected, means for causing the distance between adjacent print positions to always be a predetermined integral submultiple of the character width comprising said output pulses dimensioned to provide an available number of uniformly spaced output pulses per character which is greater than the maximum number of matrix element positions available to make up a character, and means for changing the count modulus of said print control counter in response to said input signals representing a change in character width.

12. The printer of claim 2 wherein a first plurality of print positions occur between adjacent matrix columns at a first character width, and, a second differing plurality of print positions occur between adjacent matrix columns at a second differing character width.

* * * * *

UNITED STATES PATENT OFFICE

CERTIFICATE OF CORRECTION

Patent No. 4,213,714 Dated July 22, 1980

Inventor(s) Clifford M. Jones & William A. Surber

It is certified that error appears in the above-identified patent and that said Letters Patent are hereby corrected as shown below:

Column 4, line 66, cancel "D" and insert -- $\Delta$ D --

Column 5, line 59, cancel "oppostie" and insert -- opposite --

Signed and Sealed this

Sixth Day of January 1981

[SEAL]

*Attest:*

SIDNEY A. DIAMOND

*Attesting Officer*

*Commissioner of Patents and Trademarks*